United States Patent [19]

Childress

[11] Patent Number: 4,936,238

[45] Date of Patent: Jun. 26, 1990

[54] BOAT THAT CAN HAVE DIFFERENT BOW SECTIONS AND/OR STERN SECTIONS TO PERFORM IN DIFFERENT WORK FUNCTIONS BOLTED TOGETHER WITH A WATERTIGHT SEALANT THEREBETWEEN

[76] Inventor: Joseph B. Childress, 6630 River Pl., Gulf Shores, Ala. 36542

[21] Appl. No.: 351,640

[22] Filed: May 15, 1989

[51] Int. Cl.[5] ..... B63B 3/02

[52] U.S. Cl. ..... 114/77 R; 114/352

[58] Field of Search ..... 114/352, 353, 354, 357, 114/77 R, 77 A, 248, 249

[56] References Cited

U.S. PATENT DOCUMENTS

| | | | |
|---|---|---|---|
| 957,820 | 5/1910 | Vaniman . | |
| 2,605,733 | 8/1952 | Smith . | |
| 2,847,961 | 8/1958 | Meckenstock | 114/77 R |
| 3,370,563 | 2/1968 | Muto et al. . | |
| 3,447,503 | 6/1969 | Myers . | |
| 3,508,514 | 4/1970 | Vienna . | |
| 3,557,742 | 1/1971 | Gainsley . | |
| 3,614,938 | 10/1971 | Statile . | |
| 3,650,238 | 3/1972 | Stockdale . | |
| 3,787,911 | 1/1974 | Miya . | |
| 3,799,100 | 3/1974 | Marriner . | |
| 3,816,865 | 6/1974 | Ragan . | |
| 3,878,806 | 4/1975 | Garcia . | |
| 3,938,459 | 2/1976 | Wilbanks et al. | 114/77 R |
| 4,356,784 | 11/1982 | Waters et al. . | |
| 4,522,145 | 6/1985 | Stone . | |
| 4,676,545 | 6/1987 | Bonfilio et al. | 114/357 |

FOREIGN PATENT DOCUMENTS

| | | | |
|---|---|---|---|
| 1100495 | 2/1961 | Fed. Rep. of Germany . | |
| 2049233 | 4/1972 | Fed. Rep. of Germany | 315/114 |
| 902908 | 8/1962 | United Kingdom | 450/114 |
| 2173744A | 10/1986 | United Kingdom | 114/77 R |

*Primary Examiner*—Sherman D. Basinger
*Assistant Examiner*—Stephen P. Avila
*Attorney, Agent, or Firm*—A. Robert Theibault

[57] ABSTRACT

The present disclosure is directed to a boat having a self-propelled watertight intermediate propulsion section, a watertight bow section connectable to the front of the intermediate section, a stern section connectable to the rear of said bow and intermediate section and the stern section being watertight and buoyant and having steel flat bar framing outlining the perimeter of their transverse extremities welded to the end of each said section which it abuts. Spaced openings are drilled through the flat bar framing in alignment with each section for being selectively joined by bolts and nuts to make up a boat of variable length of bolted abutting sections. A watertight bulkhead is set back from the flat bar framing and water-tight sealant means having openings in alignment with the flat bar openings of each section which makes up a water-tight modular craft of any combination of sections forwardly and rearwardly of the self-propelled intermediate propulsion section having longitudinal rigidity from bow to stern and the sections have utility for various activities such as pushing barges, towing barges, working around bridges, oystering, shrimping and the ferrying of vehicles. Each of the bow and stern sections being especially adapted for a specific activity and being selectively addable to or removable from the intermediate propulsion section to permit qualified licensed ship handlers of craft of varying length to operate a craft within their licensed length.

11 Claims, 10 Drawing Sheets

BOAT THAT CAN HAVE DIFFERENT BOW SECTIONS AND/OR STERN SECTIONS TO PERFORM IN DIFFERENT WORK FUNCTIONS BOLTED TOGETHER WITH A WATERTIGHT SEALANT THEREBETWEEN

TECHNICAL FIELD

The present invention is directed to a basic boat having at least a watertight intermediate propulsion section to which may be joined by a bolted watertight joint a bow and a stern section.

My invention provides a boat made up of independent watertight sections which are bolted together and which permits dry docking of the whole vessel or less than the whole vessel for using a smaller dry dock depending upon repairs required and which because of the bolted connection between sections and each section being watertight permits the flexibility of a multisection boat.

BACKGROUND ART

Numerous multisectional vessels are known such as shown in UK patent application No. GB 2173744A of 1986, which discloses numerous methods of joining the ship sections none of which teach or suggest bolting watertight sections together to permit dry docking less than the entire vessel. The closest art known to me at the filing of this application for joining multiple watertight working sections of a vessel having a propulsion section including crew quarters and having eating and living facilities are the following patents:

| | | |
|---|---|---|
| Germany | DAS 1,100,495 | 1961 |
| United Kingdom | 902,908 | 1962 |
| U.S. Pat. No. | 957,820 | 1910 |
| | 3,508,514 | 1970 |
| | 3,557,742 | 1971 |
| | 3,614,938 | 1971 |
| | 3,787,911 | 1974 |
| | 3,799,199 | 1974 |
| | 3,816,865 | 1974 |
| | 3,878,806 | 1975 |
| | 4,356,784 | 1982 |
| | 4,522,145 | 1985 |

BRIEF DESCRIPTION OF THE FIGURES OF DRAWINGS

DISCLOSURE OF THE INVENTION

In accordance with my invention I provide a complete vessel that can have a bow section or stern section bolted on to increase efficiency on particular or specific marine functions.

The intermediate section being the carrier of the propulsion plant, auxiliary machinery, such as air compressors and tanks, crews living and eating quarters, is the heaviest section and should be watertight at each end and the bow section which carries the top side working gear such as cranes, winches, wind-lasses, etc., being the next heaviest section should be water-tight at each end. By providing a flat bar perimeter welded to and about the end of each section with openings drilled through the flat bar equidistant from each other to receive a bolt and nut connection and a rubber or neoprene gasket having alignment openings with the flat bars of each abutting section a strong watertight connection and axial alignment along the major longitudinal axis of the vessel is attained. A watertight flexible cement may be employed in lieu of the gasket to make the underwater connections of the sections watertight. Welded to the hull of each section at a distance from the flat bar sufficient to permit passing the attaching bolts behind and through the flat bar, are watertight bulkheads welded about their contact with the hull to assure of the watertight integrity of each hull section. The stern section being the lightest section need not have a watertight bulkhead adjacent where it is joined to the intermediate section. If additional weight is added to the stern sections such as top side handling hoists, winches, capstain, etc., the watertight bulkhead should be added to the front of the stern section rearwardly of the flat bar, or if licensing requires each section to have watertight integrity.

Each of said bow and stern sections are designed to permit the vessel to be employed as a work boat for pushing barges, towing barges, working around bridge pilings, oystering and shrimping or salvage work, as well as ferrying vehicles.

DESCRIPTION OF THE PREFERRED EMBODIMENTS OF THE INVENTION

Figure 1:
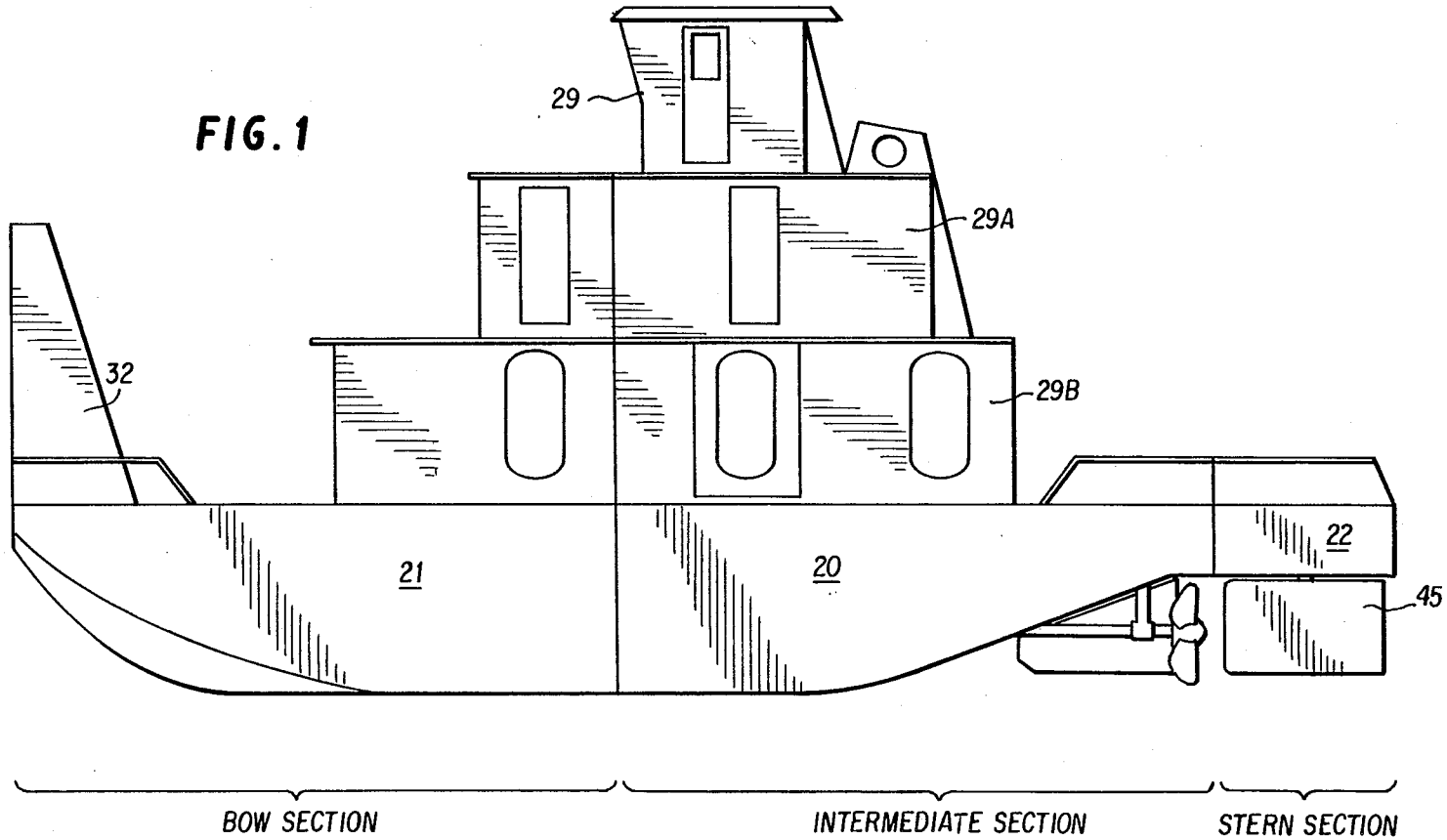
FIG. 1 is a side elevational view of a boat constructed in accordance with the present invention.

Referring to the drawings and for the moment to FIG. 1, the boat of the present invention comprises three sections 20, 21 and 22, a self-propelled intermediate section 20, a bow section 21 and a stern section 22. Each of said bow and stern sections being joined by bolting same to the intermediate section with a bolt and nut connection 23, 24 which pass through openings 25 through flat steel bar 26 which is welded to the steel plate hull 27 of each section which not only provides the mechanical strength to afford stability to the entire hull of the boat both longitudinally and transversely of the major axis of the boat but which together with a gasket 30 and a watertight bulkhead 28 divides the boat hull into the three watertight hull sections 20, 21 and 22, to permit dry docking less than the entire vessel for repairs which permits substitution of replacement bow and stern sections so the more expensive intermediate section 20, containing the power plant of multiple engines and auxiliaries in support thereof may be operated with different bow and stern section configurations for special uses while repairs are undertaken to damaged or special use bow sections which may be connected to a propulsion section 20 having multiple screws to fill a specific need where a specialized bow section is available.

Figure 3:
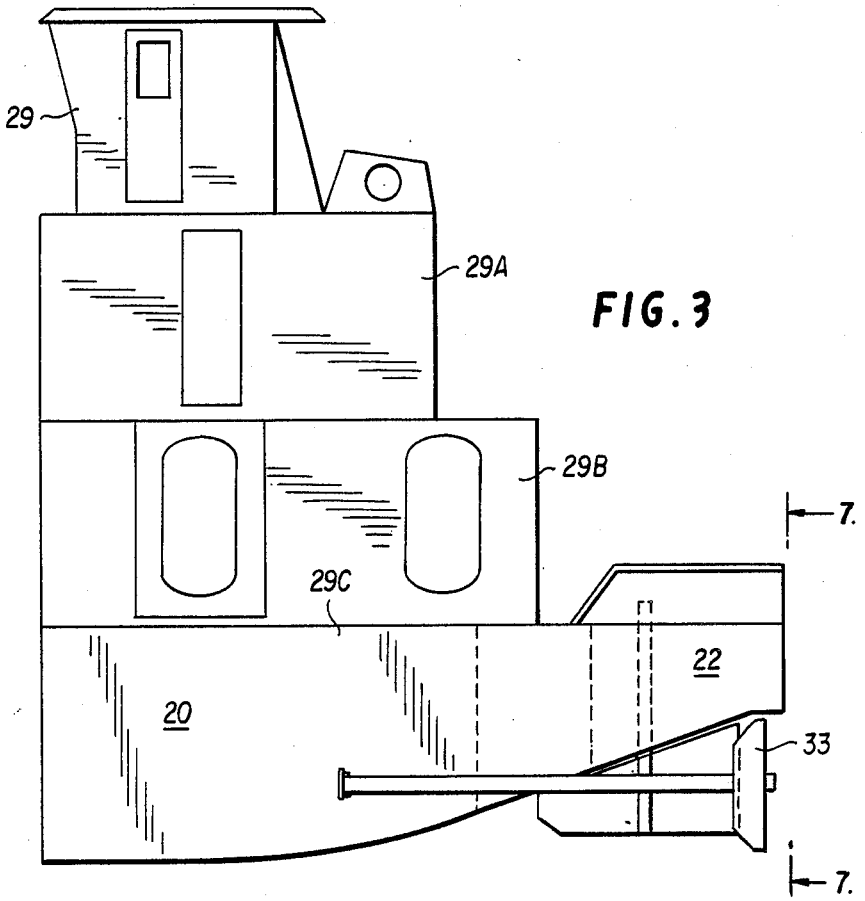
FIG. 3 is a longitudinal section taken at an enlarged scale on the line 3—3 in FIG. 2 showing the self propelled intermediate section with crews living quarters.

Referring now to FIG. 3, the intermediate section 20 has a control bridge 29 where steering and speed of the vessel is controlled in a conventional manner, 29A and 29B are crews living and dining quarters and 29C is the engine hold for controlling the speed of the shafts, port and starboard for propulsion screws 33 and 34.

Figure 2:
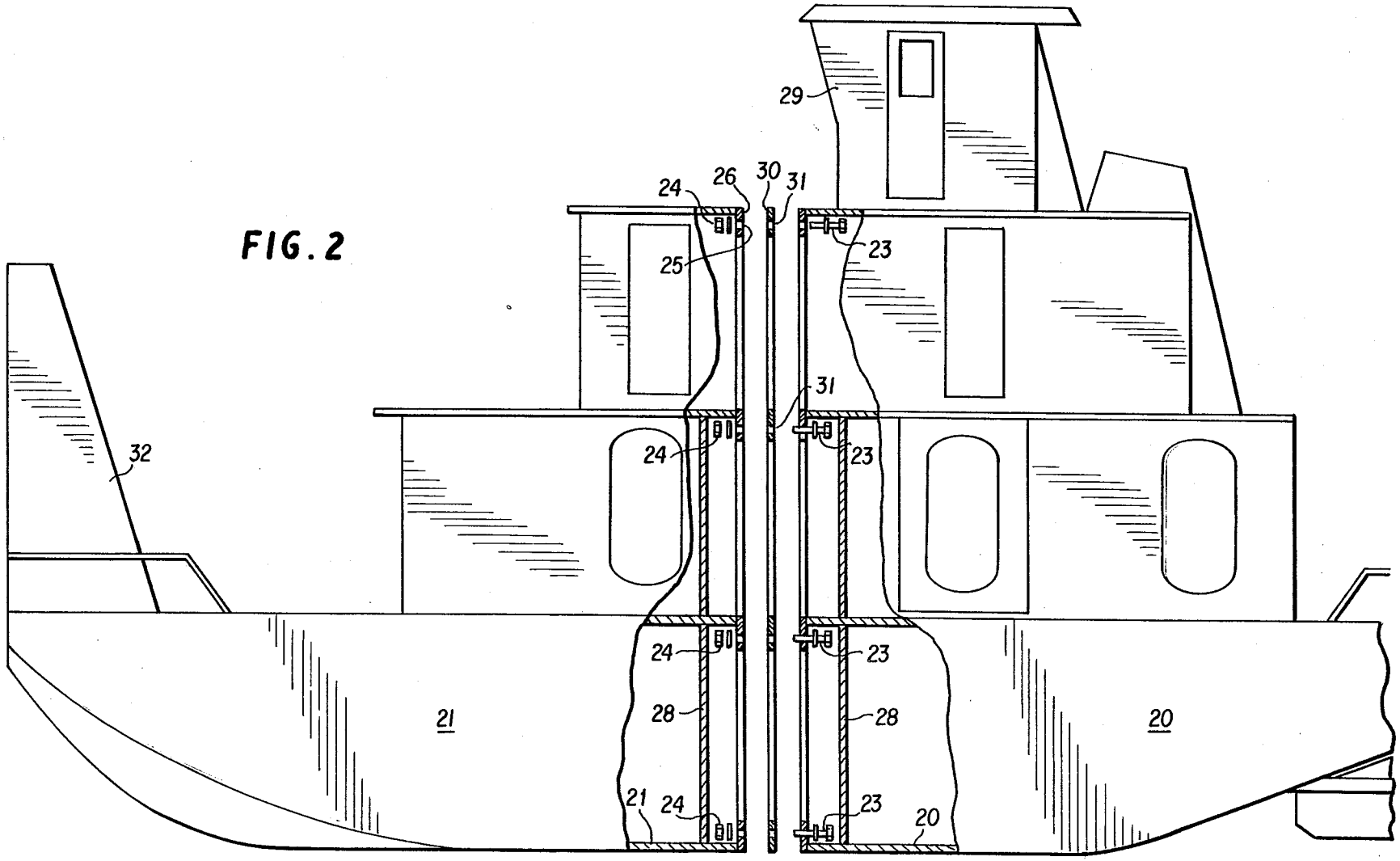
FIG. 2 is a fragmentary side elevational view with parts broken away and parts shown in section taken at an enlarged scale showing how the modular sections are joined by bolting.
Figure 5:
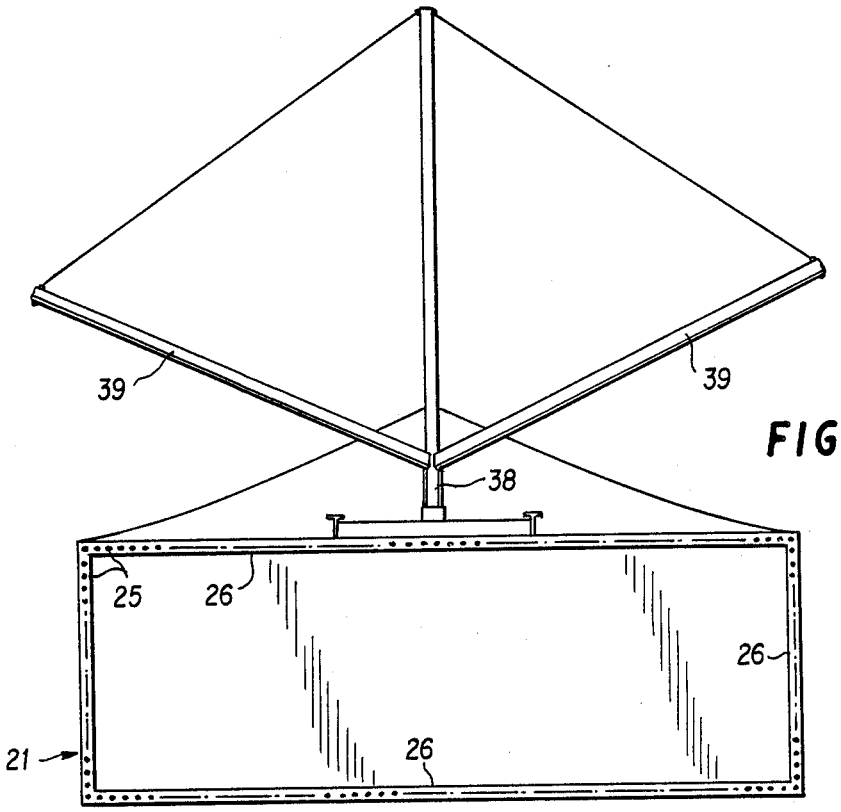
FIG. 5 is a vertical transverse sectional view of one form of bow section for shrimping adapted to be bolted to the forward end of the intermediate section of FIG. 3 along the line 5—5 in FIG. 3.

FIG. 5 is a transverse section through the lines 5—5 in FIG. 3 showing the flat steel bar 26 welded to the bow section hull 21 for receiving a plurality of bolt and nut connections between the intermediate section 20 and bow section 21. This is also best seen in FIG. 2 where bolt and nut connections 23, 24 pass through openings 25 in the flat steel bar 26 welded to the bow section 21 and intermediate section 20. A watertight gasket 30 having bolt openings 31 permits of a watertight connection between sections 20 and 21. A pair of stacked knees 32 is secured top side to the bow section 21. The watertight integrity of each section is further enhanced by the watertight bulkheads 28 welded to the hull of each section at a distance rearwardly of the flat steel bar 26 sufficient to permit insertion of the bolts 23 through the flat bar 26 to effect not only a good solid mechanical connection but also a watertight seal between the two independent sections 20, 21. The stern section 22 has perforated steel flat bar welded to its forward end for securing the stern section 22 to the rear of the intermediate section 20 in a manner similar to the joining of the bow section 21 to the intermediate section 20 as shown in FIGS. 2 and 3. Secured to the top side deck of the stern section 22 are a pair of stacked knees 36 and a towing stanchion 37 to receive a tow line for towing a line of barges, see FIGS. 4A, 4B. Located beneath the stern section 22 is a single or plural bladed rudder 45, for extra steeribility in a multi barge job.

Referring now to FIG. 5, the bow section shown has mast 38 and booms 39 for handling shrimp nets.

Figure 6:
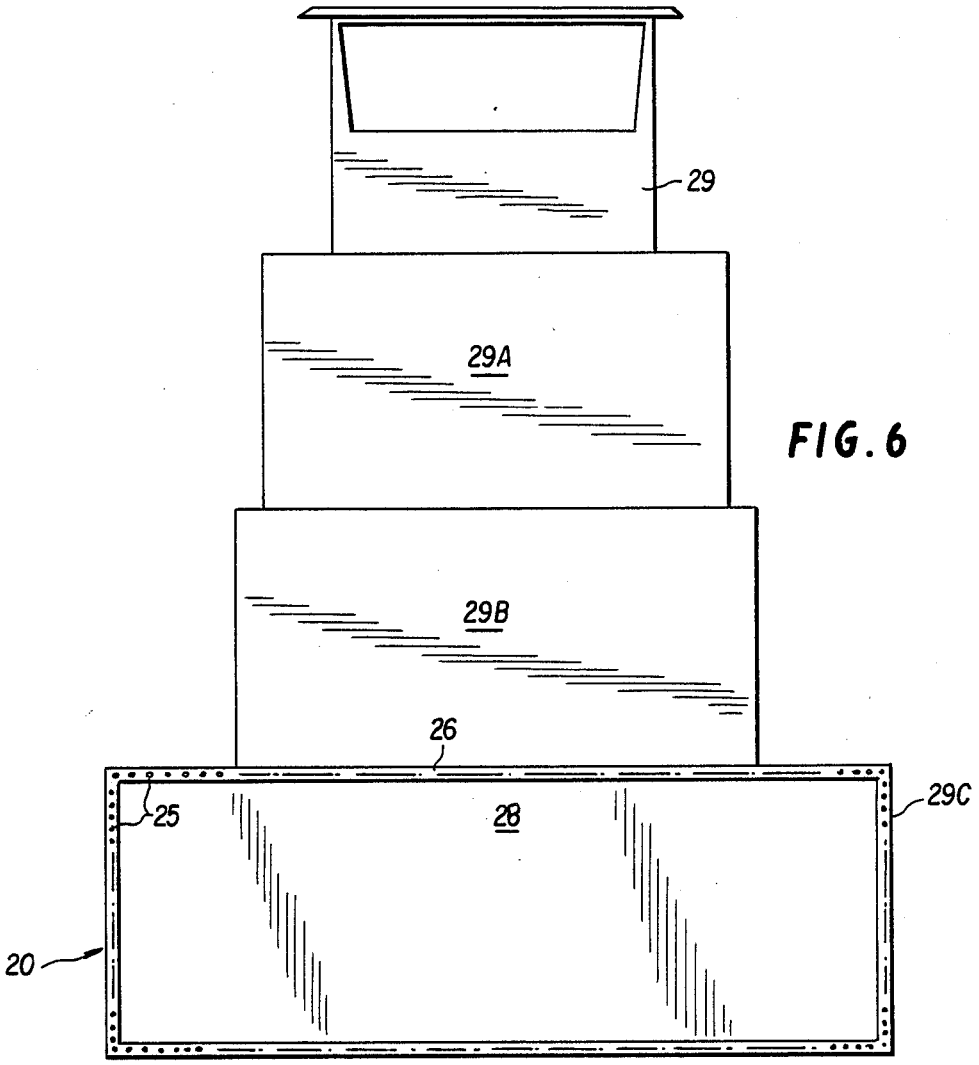
FIG. 6 is a vertical transverse elevational view taken at the forward end of the intermediate section of the boat looking aft and showing the steel flat bar for bolting a bow section to the intermediate section.

FIG. 6 shows the front end of the intermediate section with bolt openings through the steel flat bar for bolting the bow section 21 to the intermediate section 20 similar to FIG. 2.

Figure 7:
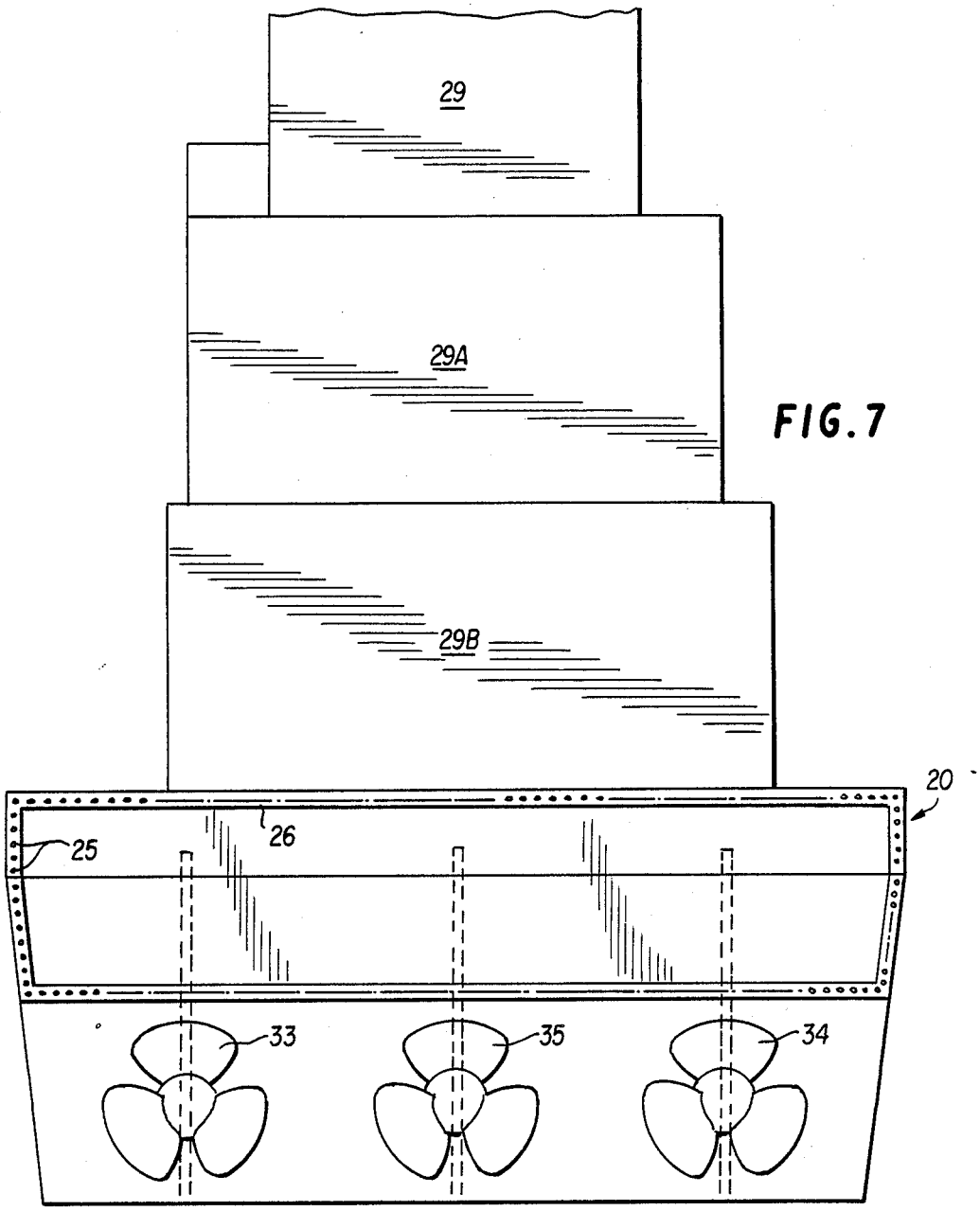
FIG. 7 is a vertical transverse elevational view taken at the rear end of the intermediate section of the boat looking forward along the lines 7—7 in FIG. 3 showing the bolting connection between the stern section and the intermediate section.

FIG. 7 shows the rear of the intermediate section 20 with the flat perforated steel bar to which the flat steel bar of the stern section 22 is to be bolted. There are three screws 20A shown, each driven by a separate engine for maneuverability.

Figure 7A:
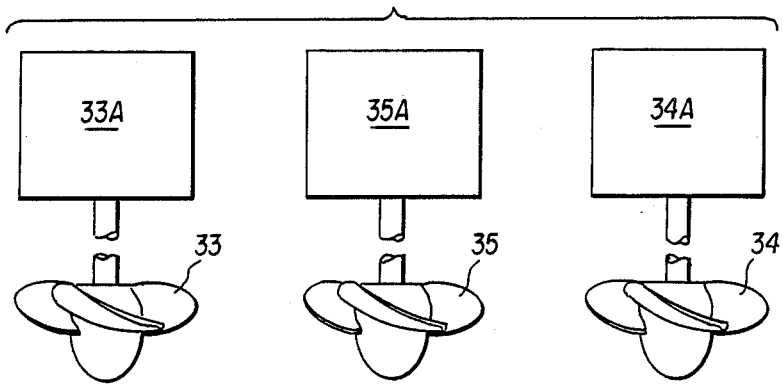
FIG. 7A is a schematic layout of three prime movers driving the three screws of FIG. 7.

FIG. 7A is a schematic layout of three prime movers driving the three screws of FIG. 7.

Figure 8:
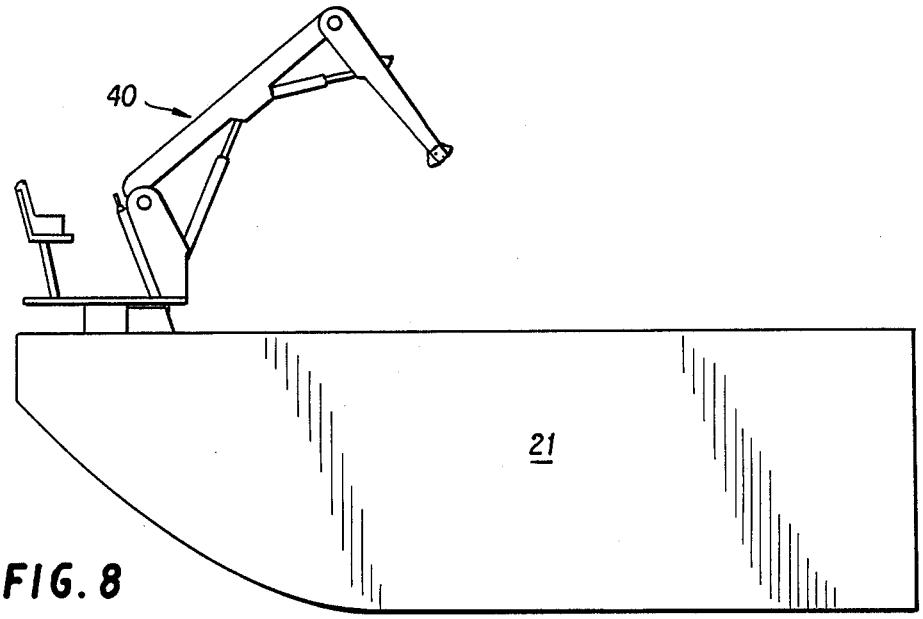
FIG. 8 is a side elevational view of a modified form of bow section containing a crane for doing bridge work.

FIG. 8 shows a special use bow section 21 having a hydraulic crane 40 for working around bridge piers or transferring loads between barges.

Figure 9:
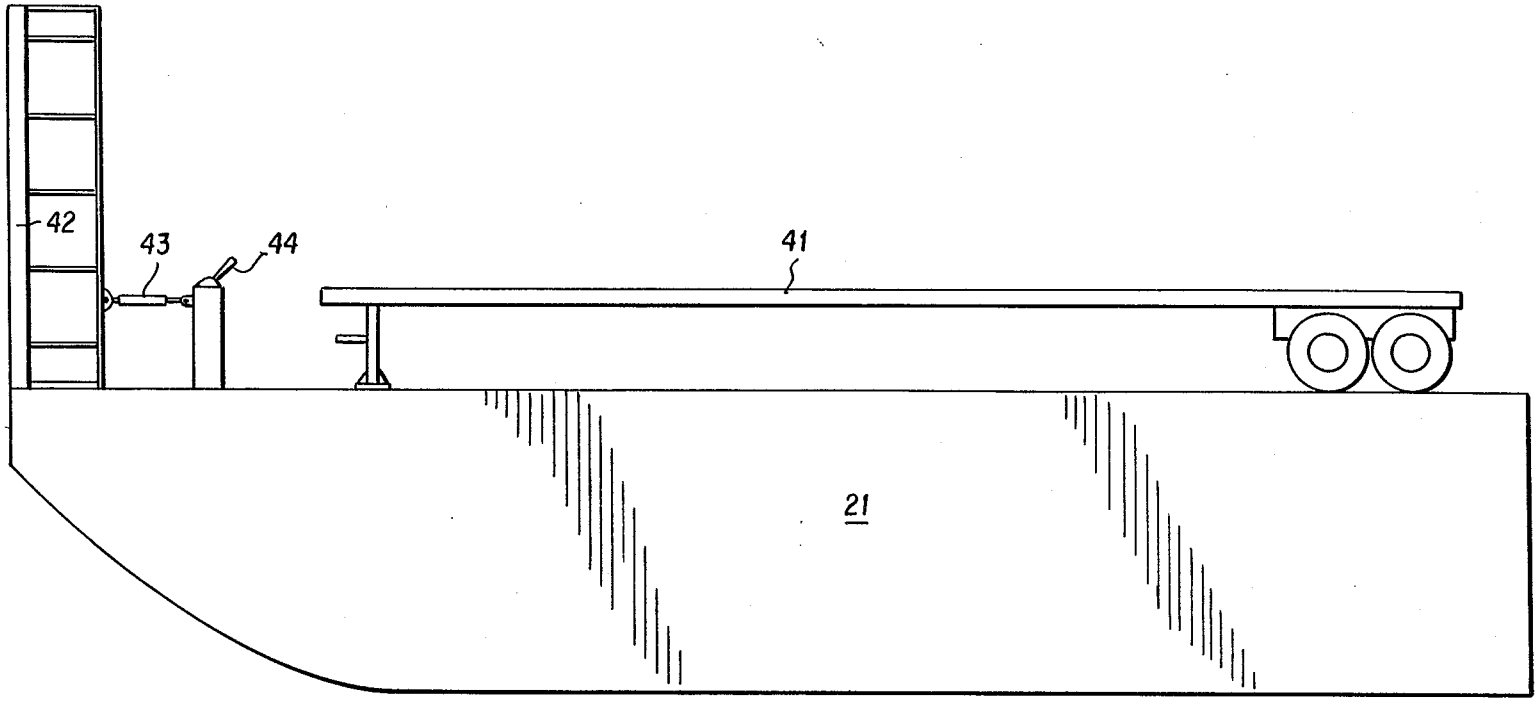
FIG. 9 is a side elevational view of a modified form of bow section containing a hydraulically actuated vehicle loading ramp for loading flat bed trailers on the bow section.

FIG. 9 shows another form of specialized bow section 21 for handling loading and unloading of flat bed trailers 41 for transport with or without load. The front end of the bow section 21 has a hydraulically operated load—unload ramp 42 controlled by cylinder 43 under control of lever 44.

Figure 10:
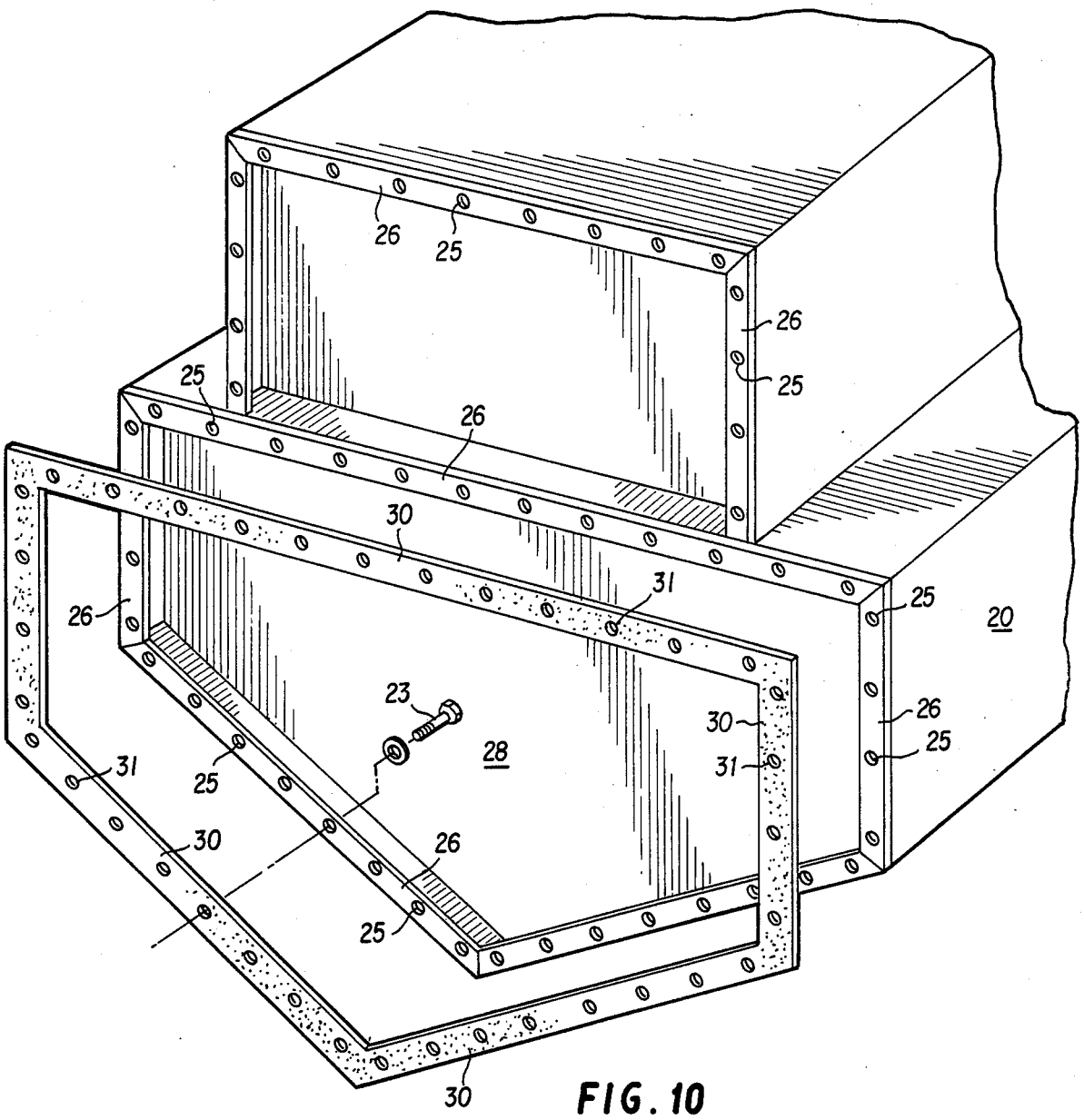
FIG. 10 is a fragmentary perspective view showing the bolted connection between the intermediate section and a bow section showing the forward watertight bulkhead of the intermediate section.

FIG. 10 shows the perforated flat steel bar welded to a hull section receiving a connector bolt 23 the head of which seats behind the flat steel bar 26 and through a bolt opening 31 in the water tight gasket 30 for joining an abutting section, for example section 20 to section 21 shown in FIG. 2. A welded watertight bulkhead 28 secured in place in each section to one side of the flat steel bar 26 adds to the watertight integrity of each section. The spacing between the watertight bulkhead 28 and flat steel bar 26 is adequate to permit insertion of the bolts 23 through the flat steel bar openings so that the bolt heads will seat against the flat steel bar 26. Where a section is being joined to another section without a watertight gasket 30 therebetween the bolt is covered with a flexible sealant of a silicone rubber calk of the type manufactured by General Electric Co. designated as Rubber Adhesive Sealant Stock #112. This is useful in joining the stern section 22 to the intermediate section 20 where the watertight bulkhead is not welded to the section rearwardly of the flat steel bar 26. The rubber silicone sealant while remaining a watertight sealant does not set up rigid but remains somewhat flexible so that it will not crack and pass water at the connection between a bolt 23 and nut 24 connection or flat steel bar connection. It will withstand hull vibrations from engines, compressors, etc without cracking or leaking. This is particularly advantageous when joining the stern section 22 to the intermediate section without a watertight bulkhead welded to the stern section aft of the flat steel bar at the front end of the stern section.

Also useable as a sealant between the flat steel bars 26, bolts 23 and 24, in lieu of watertight gaskets 30 are marine sealants designated as A-788 SPLASH ZONE COMPOUND, and epoxy coating manufactured by Koppers Co., Inc., of Pittsburgh, Pa., and VULKEM 116, a polyurethane sealant, marketed by MAMECO of Cleveland, Ohio.

Figure 4A:
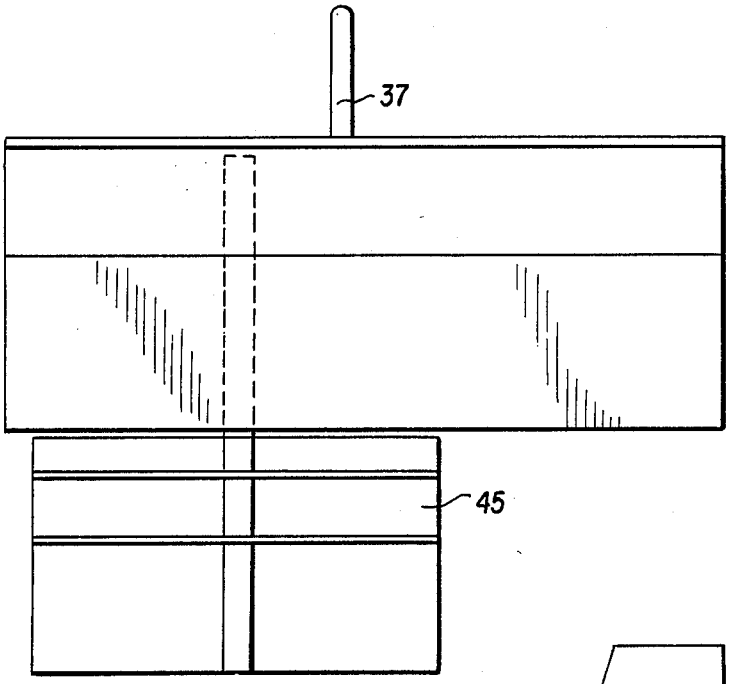
FIG. 4A is a side elevational view of one form of stern section constructed in accordance with the present invention having a towing post.
Figure 4B:
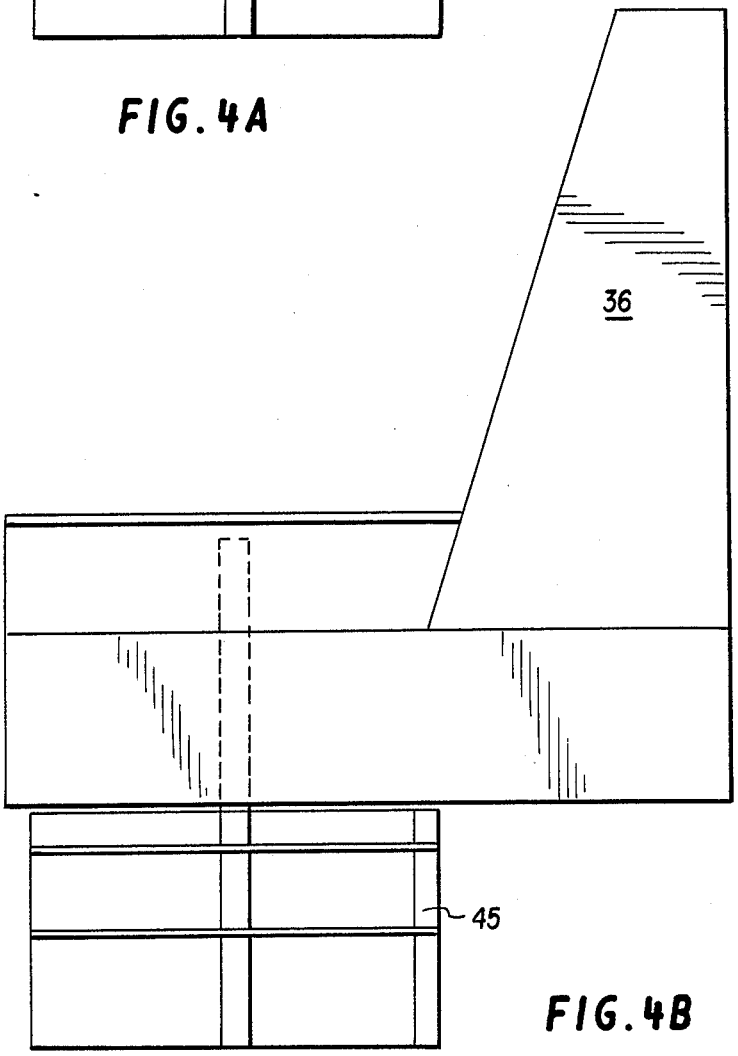
FIG. 4B is a side elevational view of a modified form of stern section having a stacked knee.

The increased rudder control as shown in FIGS. 4A and 4B may be attained by providing three horizontally spaced rudder blades 45 tied to a single hydraulic or cable control from the vessel's helm on bridge 29. The rudder blades 45 are placed one behind each screw as shown in FIG. 1 to assure maximum steering effect.

Figure 11:
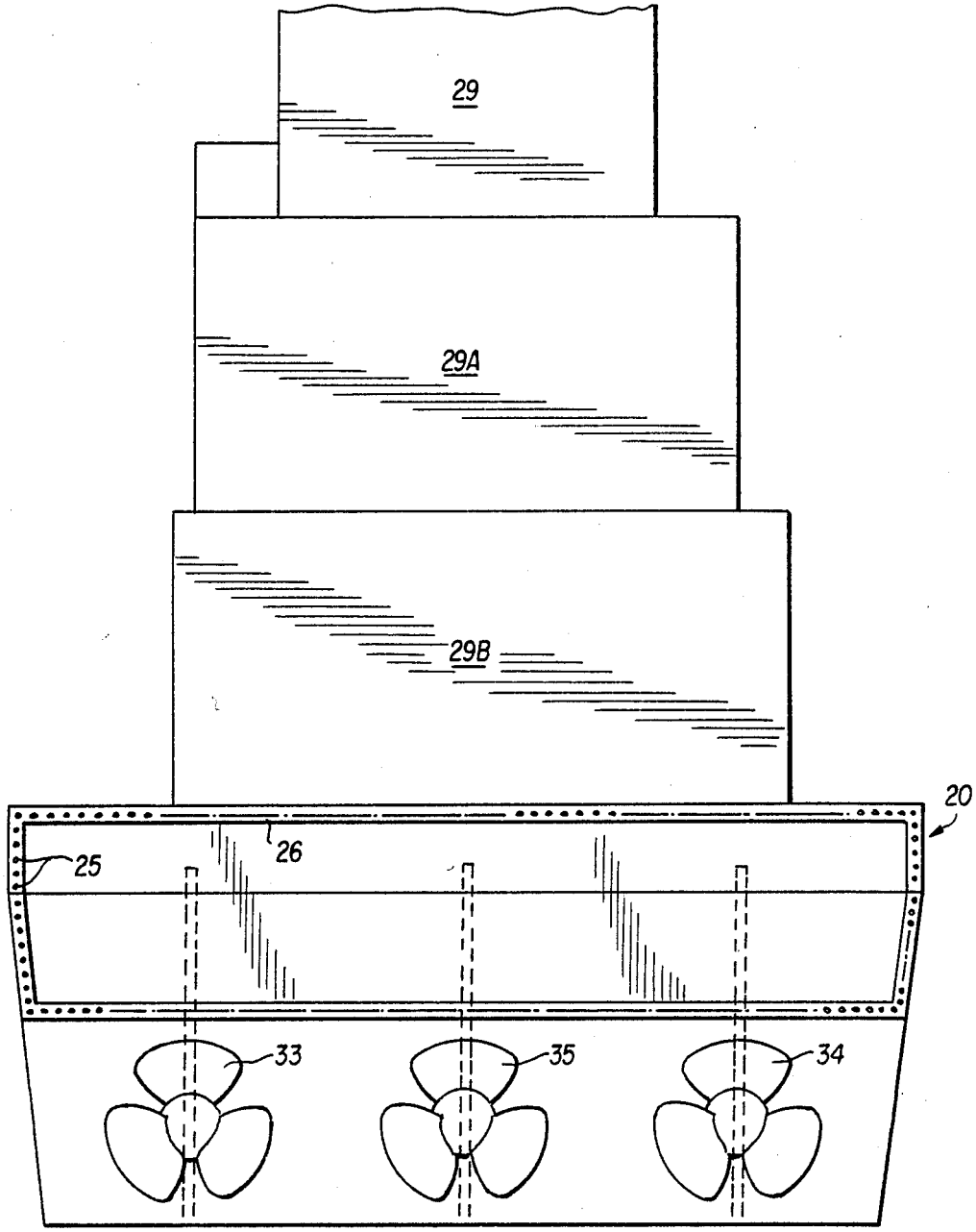
FIG. 11 is a transverse elevational view of the rear of the intermediate section showing the drilled flat bar for bolting the stern section thereto.

FIG. 11 is a view looking forward into the rear of the intermediate section 20 showing the flat steel bar 26 to which the flat steel bar 26 of the stern section is bolted. Three screws 33, 34 and 35 are shown schematically, one driven by each of three prime movers 33A, 34A, and 35A shown in FIG. 7A to permit a greater maneuverability and twisting of the boat. For instance screw 33 could be going forward while screw 35 was going rearward to impart a twist or quick turn to the boat assisted by the rudder 45. All controls for rudder and engines come from the bridge 29 of the intermediate section 20.

Figure 12:
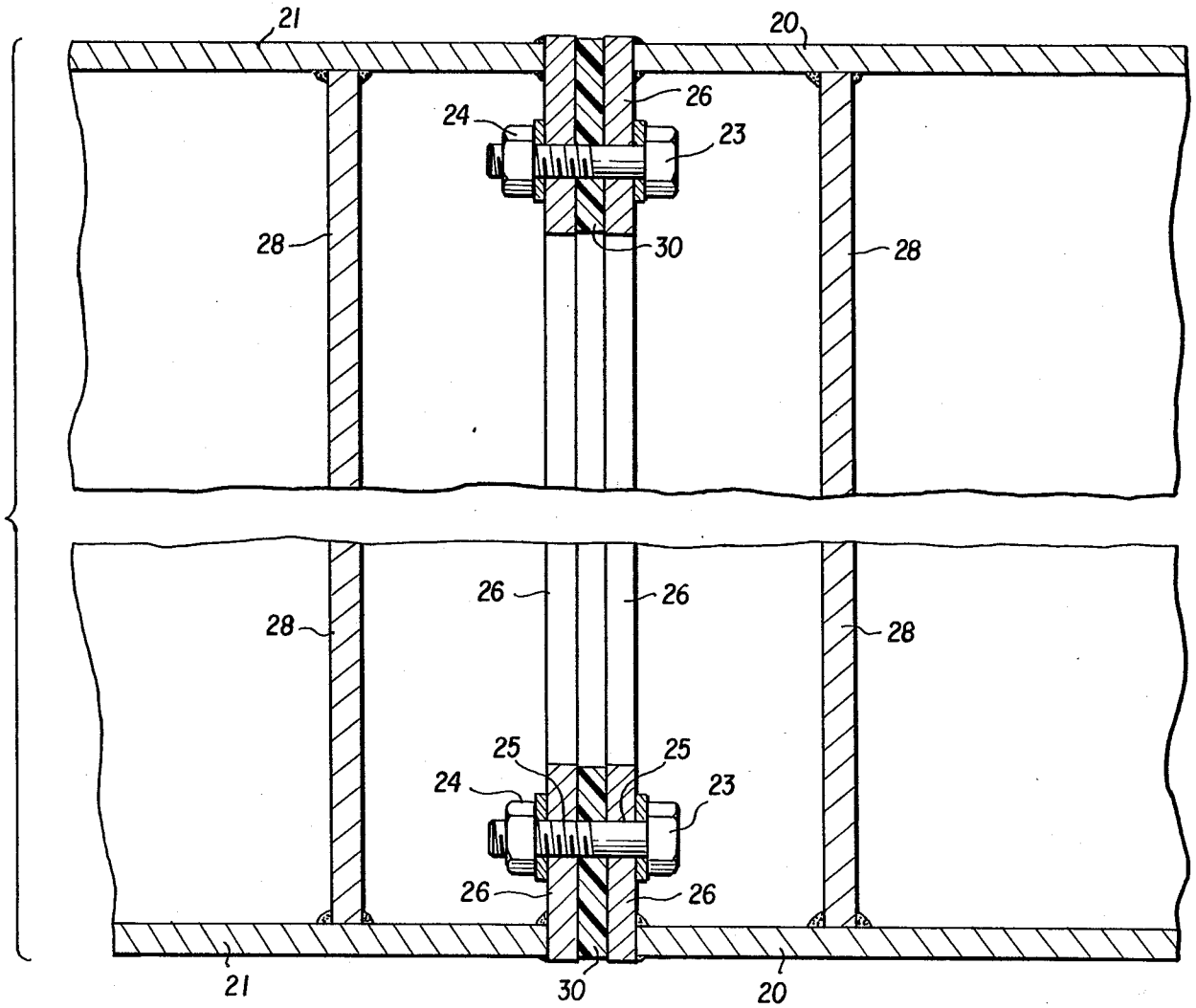
FIG. 12 is a horizontal sectional view taken at an enlarged scale showing a section through the bolted connection between the bow and intermediate sections right and left sides and showing the watertight gasket therebetween backed up with the watertight bulkheads which make each section watertight.

Referring now to FIG. 12 the joint between the intermediate section 20 and bow section 21 is shown at an enlarged scale and is broken away to show both the port and starboard sides of each section which has a flat steel bar 26 having bolt openings 25 drilled there through to permit passage of bolts 23 therethrough for joining section 21 to section 20 by a bolt 23 and nut 24 connection having a watertight gasket 30 therebetween as best seen in FIGS. 2, 10 and 12.

I claim:

1. A modular boat comprising a self propelled intermediate propulsion section, a bow section connectable to the front of said intermediate section, a stern section connectable to the rear of said intermediate section and having a plurality of propulsion screws each driven by a prime mover on said intermediate section, rudder means carried by said stern section positioned rearwardly of each propulsion screw on said intermediate section to increase maneuverability of the boat over a single screw single rudder boat for steering said self-propelled intermediate section, each of said bow section, intermediate section and stern section being watertight and having steel flat bar framing outlining their transverse extremities welded to each said section, spaced openings drilled through the flat bar framing in alignment with each section for being selectively joined by bolts and nuts to make up a craft of variable length, a watertight bulkhead set back from said flat bar framing and watertight sealant means in alignment with and coating the flat bar opening and the inclined plane surfaces of bolts and nuts fastening said intermediate section and said bow section to make up a watertight craft forwardly of said self-propelled intermediate propulsion section having utility for various activities such as pushing barges, towing barges, working around bridges, oystering, shrimping and ferrying of vehicles, each of said bow and stern sections being especially adapted for a specific activity and selectively addable to said intermediate propulsion section, said bow and stern section being removable from said intermediate propulsion section for dry docking less than the three sections or only the intermediate section and reducing the overall length of the craft and length of the drydock necessary to effect underwater repairs to the boat.

2. A boat as claimed in claim 1 wherein said intermediate section has three engines arranged athwart ship driving three propulsion screws forwardly of three rudders on the center line of each propulsion screw.

3. A boat as claimed in claim 1 wherein said bow section has a topside crane for working around bridge sections.

4. A boat as claimed in claim 1 wherein a rubber gasket is employed between the steel flat bars having spaced openings of abutting sections.

5. A boat as claimed in claim 1 wherein said bow section has a pair of stacked knees for pushing a line of barges.

6. A boat as claimed in claim 1 wherein said bow section has a top side mast and two pivoted booms for handling shrimp nets.

7. A boat as claimed in claim 1 wherein said bow section has a top side on—off loading ramp hydraulically actuated for ferrying vehicles and flat bed trailers.

8. A boat as claimed in claim 1, wherein said rudder means comprises a rudder blade positioned behind each propulsion screw connected to act in unison.

9. A modular boat as claimed in claim 1, wherein said sealant means which co-acts between said flat bar, bolts and nuts to provide a watertight seal between adjacent abutting sections is a watertight flexible cement selected from the group of a rubber silicone sealant, a marine sealant designated as A-Z788 SPLASH ZONE COMPOUND, an EPOXY coating, and a polyurethane sealant.

10. A boat comprising a self-propelled water-tight intermediate propulsion section, a water-tight bow section connectable to the front of said intermediate section, a stern section connectable to the rear of said bow sections, intermediate section and stern sections being water-tight and buoyant and having steel flat bar framing outlining the perimeter of their transverse extremities welded to the end of each said section which abuts it, spaced openings drilled through the flat bar framing in alignment with each section for being selectively joined by bolts and nuts to make up a boat of variable length, of bolted abutting sections a water-tight bulkhead set back from said flat bar framing and water-tight sealant means having openings in alignment with the flat bar openings of each section to make up a watertight modular craft of any combination of sections forwardly and rearwardly of said self-propelled intermediate propulsion section having longitudinal rigidity from bow to stern and utility for various activities such as pushing barges, towing barges, working around bridges, oystering, shrimping and ferrying of vehicles, each of said bow and stern section being especially adapted for a specific activity and selectively addable to and removable from said intermediate propulsion section to permit qualified licensed ship handlers of craft of varying length to operate a craft within their licensed length, said bow and stern sections being removable from said intermediate propulsion section for dry docking less than the three sections or only the intermediate section and reducing the overall length of the craft and length of the drydock necessary to effect underwater repairs to the boat.

11. A boat comprising a mid-section being a complete boat, a bow section connectable to the front of said intermediate section, a stern section connectable to the rear of said intermediate section to add efficiency for different applications by increasing the number of rudders for steering said self-propelled intermediate section, each of said bow section, intermediate section and stern section being watertight and having steel flat bar framing outlining their transverse extremities welded to each said section, spaced openings drilled through the flat bar framing in alignment with each section for being selectively joined by bolts and nuts to make up a craft of variable length, watertight sealant means between said flat bar and bolt and nut connections to make up a watertight craft having utility for various activities such as pushing barges, towing barges, working around bridges, oystering and shrimping, each of said bow and stern sections being especially adapted for specific activity and selectively addable to said intermediate propulsion section, said bow and stern sections being removable from said intermediate propulsion section to reduce the overall length of the craft and length of drydock necessary to effect underwater repairs to the boat.

* * * * *